US005622660A

United States Patent [19]

Uemura et al.

[11] Patent Number: 5,622,660

[45] Date of Patent: Apr. 22, 1997

[54] PROCES FOR PRODUCING CARBON FIBER FABRICS

[75] Inventors: Seiichi Uemura, Ota-ku; Yoshio Sohda, Kawasaki; Yasuzi Ido, Yokohama, all of Japan

[73] Assignee: Nippon Oil Company, Limited, Tokyo, Japan

[21] Appl. No.: 370,027

[22] Filed: Jan. 9, 1995

Related U.S. Application Data

[63] Continuation-in-part of Ser. No. 231,898, Apr. 22, 1994, abandoned, which is a continuation of Ser. No. 794,457, Nov. 19, 1991, abandoned, which is a continuation of Ser. No. 479,855, Feb. 14, 1990, abandoned.

[30] Foreign Application Priority Data

Feb. 16, 1989 [JP] Japan ..... 1-35008

[51] Int. Cl.[6] ..... D01F 9/12; D01F 9/145

[52] U.S. Cl. ..... 264/29.2; 264/29.7; 264/211.11; 423/447.8

[58] Field of Search ..... 264/29.2, 29.6, 264/29.7, 211.11; 423/447.8

[56] References Cited

U.S. PATENT DOCUMENTS

| | | | |
|---|---|---|---|
| 3,764,662 | 10/1973 | Roberts, Jr. | 423/447.8 X |
| 3,859,158 | 1/1975 | Park | 264/29.2 X |
| 3,972,968 | 8/1976 | Kohn | 264/29.2 |
| 4,138,525 | 2/1979 | Schulz | 264/29.2 X |
| 4,849,200 | 7/1989 | Uemura et al. | 264/29.2 X |
| 4,863,708 | 9/1989 | Seo et al. | 423/447.8 X |
| 4,915,926 | 4/1990 | Lahijani | 423/447.8 X |
| 4,975,262 | 12/1990 | Suto et al. | 264/29.2 X |

FOREIGN PATENT DOCUMENTS

| | | | |
|---|---|---|---|
| 62-20281 | 5/1987 | Japan . | |
| 63-120136 | 5/1988 | Japan . | |
| 1308536 | 2/1973 | United Kingdom | 423/447.8 |

OTHER PUBLICATIONS

Abstract of Japan 63–243,329, Published Oct. 11, 1988 (Derwent WPI Acc. No. C 88–328011/46).

Abstract of Japan 1–45,819, Published Feb. 20, 1989 (Chemical Abstracts, vol. 111, No. 24892d).

Volk, H.F. "High–Modulus Pitch–Based Carbon Fibers", Presented At The Symposium On Carbon–Fiber–Reinforced Plastics, Bamberg, West Germany, May 11–12, 1977.

*Primary Examiner*—Leo B. Tentoni
*Attorney, Agent, or Firm*—Scully, Scott, Murphy & Presser

[57] ABSTRACT

A process for producing a process for producing a two- or three-dimensional carbon fabric, which process includes melt-spinning (a) an optically anisotropic carbonaceous pitch having an optically anisotropic phase content of 60 to 100%, subjecting the thus- infusibilized fibers to a primary heat treatment at a temperature greater than 1000° and not higher than 2500° C. to produce primary heat treated fibers having a tensile strength not lower than 300 kg/mm$^2$ and a breaking elongation in the range of 0.4% to 10%, preparing a two- or three-dimensional fabric from the primary heat treated fibers and then subjecting the two- or three-dimensional fabric to a secondary heat treatment at a temperature which is at least 50° higher than the temperature used in the primary heat treatment, the temperature in the secondary heat treatment being higher than 1050° C. and no higher than 3300° C.

8 Claims, No Drawings

PROCES FOR PRODUCING CARBON FIBER FABRICS

CROSS-REFERENCE TO RELATED APPLICATIONS

This application is a continuation-in-part of U.S. patent application Ser. No. 08/231,898, filed Apr. 22, 1994, now abandoned, which is a continuation of U.S. patent application, Ser. No. 07/794,457,filed Nov. 19, 1991, now abandoned, which is a continuation of U.S. patent application, Ser. No. 07/479,855, filed Feb. 14, 1990, now abandoned.

BACKGROUND OF THE INVENTION

The present invention relates to a process for producing carbon fiber fabrics.

As methods for producing carbon fiber fabrics there are known a method of weaving carbon fibers as a finished product and a method in which an intermediate product is subjected to weaving and the resulting fabric is carbonized or graphitized. As an example of the latter there is disclosed in Japanese patent Laid-Open No. 120136/1988 a three-dimensional fabric containing a pitch based carbon fiber as one component thereof, the carbon fiber having, before heat treatment in a relaxed state, a strength of 15 to 250 kg/mm$^2$, an elongation to failure of 0.5% to 8.0% and an elastic modulus of 400 to 40,000 kg/mm$^2$, but, after the said heat treatment, capable of increasing in both strength and elastic modulus to 1.1 times as high as the strength and elastic modulus before the heat treatment and capable of becoming in strength 150 kg/mm$^2$ or higher and in elastic modulus 40,000 kg/mm$^2$ or higher. However, fuzzing is apt to occur because of deficient tensile strength.

In Chemical Abstracts Vol. 111, No. 24892d there is disclosed a process for producing a carbon fiber fabric which process comprises infusibilizing pitch fibers from an optically anisotropic pitch, followed by heat treatment at 300°–800° C., then making the resulting carbon fibers having a tensile strength of 0.4 GPa and an elongation at break of 1.5% into a fabric, followed by lamination and subsequent calcining at 2,500° C. However, fuzz is apt to occur because of the use of low heat treatment temperature before weaving, and deficient tensile strength.

In Derwent WPI Acc. No. C 88-328011/46 it is disclosed that, using carbon fibers produced by carbonizing fibers from mesophase pitch at 550°–1,000° C. and having a tensile strength of 20–40 kg/mm$^2$ and an elongation at break of 1.8–4.0%, a fabric is produced and graphitized. Also in this case, however, fuzz is apt to occur because of low heat treatment temperature before weaving and deficient tensile strength.

And in Japanese Publication No. 20281/1987 there is disclosed a process for producing a carbon fiber product in which as-spun pitch fibers are subjected to an initial carbonization treatment, then a bundle of the fibers is subjected to weaving and the resulting fabric is carbonized or graphitized. Fuzz is apt to occur, however, because of low heat treatment temperature before weaving, and deficient tensile strength.

Further, in Carbon Fiber Reinforced Plastics, Bamberg, West Germany, May 11–12, 1977 there is a description to the effect that infusibilized fibers can be woven if they have a strength of about 40 kg/mm$^2$ and elongation to failure of 5%, and can be carbonized into a carbon fiber fabric. Fuzz is apt to occur, however, because of low heat treatment temperature before weaving, and deficient tensile strength.

In U.S. Pat. No. 4,138,525 it is disclosed that infusibilized fibers having an elongation at break of 2.1 to 5.6% and a tensile strength of 17,000 to 37,000 psi are made into cloth and carbonized or graphitized. However, fuzzing occurs easily due to low heat treatment temperature before weaving and deficient tensile strength.

In producing fabrics according to the aforementioned conventional methods, there occurs breaking of fibers or fuzzing because the strength of fibers in the weaving stage is not sufficiently high, and therefore even in the resulting fabric is carbonized or graphitized, it is impossible to obtain a high fiber volume fabric. Or there remains permanent strain after carbonization, so the inherent strength cannot be developed when used as a composite material.

SUMMARY OF THE INVENTION

It is the object of the present invention to overcome the above-mentioned problems, particularly to provide a process capable of efficiently producing carbon fiber fabrics with few fuzzing and free of permanent strain.

It is an extremely important object of the present invention to produce a composite material having a high fiber volume content and high strength and elastic modulus by using a carbon fiber fabric and minimizing the damage of fibers during production of the composite material. The present invention has made it possible to obtain a composite material which satisfies such object.

The present invention is concerned with a process for producing a process for producing a two- or three-dimensional carbon fabric, which process comprises melt-spinning (a) an optically anisotropic carbonaceous pitch having an optically anisotropic phase content of 60 to 100%, subjecting the thus- infusibilized fibers to a primary heat treatment at a temperature greater than 1000° and not higher than 2500° C. to produce primary heat treated fibers having a tensile strength not lower than 300 kg/mm$^2$ and a breaking elongation in the range of 0.4% to 10%, preparing a two- or three-dimensional fabric from said primary heat treated fibers and then subjecting said two- or three-dimensional fabric to a secondary heat treatment at a temperature which is at least 50° higher than the temperature used in said primary heat treatment, said temperature in the secondary heat treatment being higher than 1050° C. and no higher than 3300° C.

DETAILED DESCRIPTION OF THE INVENTION

The process for producing carbon fiber fabrics according to the present invention will be described in detail hereinafter.

As the carbonaceous pitch there is used a coal or petroleum pitch having a softening point of 100° C. to 400° C., preferably 150° to 350° C. Both optically isotropic and anisotropic pitches are employable examples of the carbonaceous pitch, but particularly preferred is an optically anisotropic pitch having an optically anisotropic phase content of 60% to 100%.

In the present invention there preferably are employed primary heat-treated fibers exhibiting an elastic modulus of $40\times10^3$ kg/mm$^2$ or more when heat-treated at 2,500° C. and an elastic modulus of $50\times10^3$ kg/mm$^2$ when heat-treated at 2,800° C.

The melt spinning may be carried out by any suitable known method. The resulting pitch fibers are then rendered infusible.

The infusibilization treatment may be performed at a temperature of 50° C. to 400° C., preferably 100° to 350° C., in an oxidizing gas atmosphere. As the oxidizing gas there may be used any of air, oxygen, nitrogen oxide, sulfur oxide, halogen, and a mixture thereof.

The primary heat treatment is conducted in an inert gas at a temperature exceeding 1000° C. and not higher than 2,500° C., preferably in the range of 1,100° to 2,000° C., more preferably 1,500° to 2,000° C. The treatment time is selected suitably so as to obtain primary heat-treated fibers having later-described tensile strength and elongation to failure, but usually it is in the range of 1 second to 10 hours. According to a method wherein fibers which have been treated at a temperature lower than the above range are subjected to weaving, followed by heat treatment at a high temperature, there remains so-called permanent strain or permanent deformation of the fibers because of a low carbonized state, and thus since the fibers are woven in a bent state, breakage will result at inflection points if pulled.

It is also preferable that, before the primary heat treatment, the infusibilized fibers be pre- carbonized at a temperature exceeding 650° C. and not higher than 1,000° C. in an inert gas.

The primary heat-treated fibers, obtained by going through the above primary heat treatment, have a tensile strength exceeding 250 kg/mm$^2$ and a breaking elongation of 0.4% to 10%.

It is an essential condition that the tensile strength of the primary heat-treated fibers should be not lower than 300 kg/mm$^2$, more preferably not lower than 360 kg/mm$^2$, and most preferably not lower than 330 kg/mm$^2$. Although there is no upper limit, the tensile strength in question is usually not higher than 1000 kg/mm$^2$. If the tensile strength is outside the range just specified, there will occur breakage of fibers and fuzz during weaving, resulting in that a high fiber volume fabric, (more specifically, a three-dimensional fabric having a lower limit of fiber volume content Vf of 35%, preferably 40%, most preferably 45%, and an upper limit of Vf of 70%, preferably 65%, most preferably 60%), cannot be obtained.

The elongation to failure is in the range of 0.4% to 10%, preferably 0.6% to 10%, more preferably 0.7% to 5%. A three-dimensional fabric, especially a fabric having a large fiber volume content Vf is small in radius of curvature, so in order to minimize the damage of fibers during or after weaving, it is desirable that the elongation at break be 0.6% or more. In the case of a three-dimensional fabric then, it is preferable that the elongation to failure be not lower than 0.6% because of a small radius of curvature of bundle in a fabric.

The value of elastic modulus is determined optionally according to the combination of the above tensile strength and elongation to failure. The primary heat-treated fibers exhibit an elastic modulus of 40×10$^3$ kg/mm$^2$ or more, preferably 45×10$^3$ kg/mm$^2$ or more, more preferably 50×10$^3$ kg/mm$^2$ or more, when heat-treated at 2,500° C. in a non-oxidative atmosphere, and at 2,800° C., they exhibit an elastic modulus of 50×10$^3$ kg/mm$^2$ or more, preferably 55×10$^3$ kg/mm$^2$ or more, more preferably 60×10$^3$ kg/mm$^2$ or more. If the elastic modulus after heat treatment does not fall under the above ranges, the resulting composite material will be low in elastic modulus, and the strength thereof will also be deteriorated particularly in the combination with a fragile matrix such as carbon or ceramic material.

The fiber diameter is in the range of 3 to 100 μm, preferably 5 to 30 μm.

In the present invention, the foregoing primary heat-treated fibers are made into a two- or three-dimensional fabric. Examples of the "fabric" as referred to herein are fabrics obtained using 100 to 25,000 continuous filaments. More concrete examples include two dimensional fabrics such as plain weave, satin weave, twill weave, bias weave fabrics braid, and stitch knit, three dimensional fabrics such as three-dimensional orthogonal fabric, leno, interlock and braid, as well as fabrics reinforced in three or more directions such as special shape fabrics, matte-like fabric and felt-like fabric.

The fabrics of the primary heat-treated fibers is subjected to a secondary heat treatment. The secondary heat treatment is performed at a temperature which is higher than 1050° C., for example in the range of 1150° C. to 3300° C., preferably 1550° C. to 3000° C., more preferably 2500° to 2800° C., and which is higher than the temperature in the primary heat treatment. Thus, where the primary heat treatment is at 1100° C., the secondary heat treatment may be at least 1150° C. or preferably at least 1550° C. Usually, the secondary heat treatment temperature is higher by 50° C. or more preferably by 100°–2000° C., more preferably by 200°–1000° C., than the primary heat treatment temperature. The treatment time in the secondary heat treatment is selected optionally for obtaining the secondary heat-treated fabric falling under the scope of the present invention, but usually it is in the range of 1 second to 10 hours.

According to the process of the present invention there can be obtained a carbon fiber fabric with few fuzzing and free of permanent strain.

The following examples are given to illustrate the present invention more concretely.

EXAMPLE 1–5

A carbonaceous pitch was melt-spun and the resultant fibers were rendered infusible. The fibers thus infusibilized were subjected to a primary heat treatment at temperatures ranging from 1700° C. to 2450° C. Using the fibers thus heat treated, three-dimensional orthogonal fabrics were produced. Then, the fabrics were each subjected to a secondary heat treatment at 2500° C. and 2800° C. The three-dimensional fabrics thus heat treated were evaluated, the results of which are as shown in Table 1.

COMPARATIVE EXAMPLES 1–6

Three-dimensional orthogonal fabrics were produced using the primary heat-treated fibers shown in Table 1, and then subjected to a secondary heat treatment at 2500° C. The three-dimensional fabrics thus heat treated were evaluated, the results of which are as set forth in Table 1.

TABLE 1

| | Primary Heat-Treated Fibers/Secondary Heat-Treated Fibers | | | | | | | |
|---|---|---|---|---|---|---|---|---|
| | Tensile Strength kg/mm$^2$ | Elongation to Failure % | Elastic Modulus $\times 10^3$ kg/mm$^2$ | Treating Temp. °C. (treatment time sec) | Elastic Modulus after heat Treatment at 2500° C. $\times 10^3$ kg/mm$^2$ | Elastic Modulus after heat Treatment at 2800° C. $\times 10^3$ kg/mm$^2$ | Three-dimensional Fabric Vf | Evaluation |
| Example | | | | | | | | |
| 1 | 300 | 0.75 | 40 | 2100 (10) | 50 | 80 | 43 | good |
| 2 | 330 | 0.83 | 40 | 2100 (5) | 50 | 80 | 46 | good |
| 3 | 370 | 1.20 | 30 | 2000 (5) | 50 | 80 | 43 | good |
| 4 | 430 | 1.30 | 33 | 2000 5) | 53 | 85 | 46 | good |
| 5 | 350 | 0.70 | 50 | 2450 (10) | 53 | 85 | 46 | good |
| Comparative Example | | | | | | | | |
| 1 | 205 | 0.70 | 29.3 | 1700 | 53 | 85 | 30 | fuzzy |
| 2 | 245 | 0.50 | 48.8 | 2450 | 50 | 80 | 30 | fuzzy |
| 3 | 10 | 3.0 | 0.3 | 600 | 20 | 30 | 30 | permanent strain |
| 4 | 44 | 2.2 | 2.0 | 700 | 53 | 80 | 30 | fuzzy |
| 5 | 40 | 1.5 | 2.8 | 800 | 72 | 85 | 30 | fuzzy |
| 6 | 260 | 0.9 | 28 | 1500 | 71 | 85 | 30 | breakage of fibers |

In the Examples, under the conditions recited, fabric free of fuzziness with excellent elastic modulus and good fiber volume is shown to be produced in accordance with the invention. Best results were achieved at the highest primary heat treatment temperature.

In Comparative Examples 1 and 2, it may be seen that low tensile strength in the primary heat-treated fibers resulted in undesirable fuzziness in the fabric, even at higher treatment temperatures. Comparative Example 3 shows permanent strain arising from an insufficient primary heat treatment temperature. Even with increased temperature, fuzziness resulted in Comparative Examples 4 and 5.

While the use of higher tensile strength fiber in Comparative Example 6, even at a modest primary heat treatment temperature afforded a fabric evaluated as good in fuzziness and absence of permanent strain, and fiber volume was good, modulus at the preferred higher secondary heat treatment was marginal (compare the improvement in modulus values in Examples 1–5 at the higher secondary heat treatment temperature.

What is claimed is:

1. A process for producing a two- or three-dimensional carbon fabric comprising melt-spinning an optically anisotropic carbonaceous pitch having an optically anisotropic phase content of 60% to 100% whereby a pitch fiber is formed; heat treating said pitch fiber wherein said fiber is infusibilized; subjecting the infusibilized fiber to a primary heat treatment at a temperature of more than 1000° C. but not higher than 2500° C. to produce primary heat treated fiber having a tensile strength of not less than 300 kg/mm$^2$ and a breaking elongation in the range of 0.4% to 10%; preparing a two- or three-dimensional fabric from said primary heat treated fiber; and subjecting said two- or three-dimensional fabric to a secondary heat treatment at a temperature which is at least 50° C. higher than the temperature of said primary heat treatment step, said secondary heat treatment step temperature being higher than 1050° C. but no higher than 3300° C. wherein said fiber of said fabric exhibits an elastic modulus of at least 40,000 kg/mm$^2$ when said secondary heat treatment temperature, conducted in a non-oxidative atmosphere, is 2500° C. and at least 50,000 kg/mm$^2$ when said secondary heat treatment temperature, conducted in a non-oxidative atmosphere, is 2800° C.

2. The process according to claim 1 wherein the primary heat treatment temperature is in the range of 1000° to 2000° C.

3. The process according to claim 1 wherein the tensile strength of the primary heat treated fiber is no more than 1000 kg/mm$^2$.

4. The process according to claim 3 wherein the tensile strength of the carbon fiber is greater than 330 kg/mm$^2$.

5. The process according to claim 1 wherein the primary heat treatment is conducted at a temperature ranging between 1500° to 2000° C.

6. The process according to claim 1 wherein the breaking elongation of the carbon fiber is in the range of 0.6% to 10%.

7. The process according to claim 1 wherein the breaking elongation of the carbon fiber is in the range of 0.6% to 5%.

8. The process of claim 1 wherein the fabric is three dimensional, and the fiber volume is at least 35%.

* * * * *